US007811513B2

(12) United States Patent
Johnson et al.

(10) Patent No.: US 7,811,513 B2
(45) Date of Patent: Oct. 12, 2010

(54) METHOD AND APPARATUS FOR TREATING MARINE GROWTH ON A SURFACE

(76) Inventors: Keith Johnson, Commercial Diving Services Pty Ltd., 88 Yallah Road, Dapto (AU) NSW 2530; Timothy Johnson, Commercial Diving Services Pty Ltd., 88 Yallah Road, Dapto (AU) NSW 2530

( * ) Notice: Subject to any disclaimer, the term of this patent is extended or adjusted under 35 U.S.C. 154(b) by 365 days.

(21) Appl. No.: 10/596,269

(22) PCT Filed: Nov. 26, 2004

(86) PCT No.: PCT/AU2004/001642

§ 371 (c)(1),
(2), (4) Date: Feb. 4, 2009

(87) PCT Pub. No.: WO2005/056382

PCT Pub. Date: Jun. 23, 2005

(65) Prior Publication Data

US 2009/0127203 A1 May 21, 2009

(30) Foreign Application Priority Data

Dec. 9, 2003 (AU) ..... 2003906833

(51) Int. Cl.
*B08B 17/00* (2006.01)

(52) U.S. Cl. ..... 422/6; 422/38; 405/211

(58) Field of Classification Search ..... 422/6, 422/38

See application file for complete search history.

(56) References Cited

U.S. PATENT DOCUMENTS

| | | | |
|---|---|---|---|
| 1,319,550 | A | 10/1919 | Wilson |
| 5,294,351 | A | 3/1994 | Clum et al. |
| 5,327,848 | A | 7/1994 | Hannon |
| 5,389,266 | A | 2/1995 | Clum et al. |
| 5,558,108 | A | 9/1996 | Croswell, Sr. |
| 5,593,636 | A | 1/1997 | Putz |
| 5,954,977 | A | 9/1999 | Miller et al. |

FOREIGN PATENT DOCUMENTS

| | | | |
|---|---|---|---|
| FR | 2700240 | | 7/1994 |
| FR | 2705531 | | 12/1994 |
| FR | 2767643 | | 3/1999 |
| GB | 1545232 | | 5/1979 |
| JP | 8154559 | A2 | 6/1996 |
| JP | 2001-231431 | | 8/2001 |
| SU | 1119-924 | A | 10/1984 |
| SU | 1581649 | A1 | 7/1990 |
| WO | WO 00/68070 | | 11/2000 |
| WO | WO 00/78605 | A1 | 12/2000 |
| WO | WO02/44020 | | 6/2002 |
| WO | WO02096748 | | 12/2002 |

*Primary Examiner*—Elizabeth L McKane
(74) *Attorney, Agent, or Firm*—Kelly Lowry & Kelley, LLP; Scott W. Kelley

(57) ABSTRACT

The present invention relates to a method and apparatus for treating of marine growth on the surface, such as the holes of boats and ships.

A confinement arrangement is used to confine a volume of heated fluid against the surface. The confinement arrangement is retained against the surface by maintenance and mounts rollers so that it can be moved over the surface to treat other parts of the surface. A heated fluid is provided to the confined volume from an external heater.

22 Claims, 5 Drawing Sheets

METHOD AND APPARATUS FOR TREATING MARINE GROWTH ON A SURFACE

FIELD OF THE INVENTION

The present invention relates to a method and apparatus for treating marine growth on a surface and, particularly, but not exclusively, to a method and apparatus for treating marine growth on boats and ships hulls and other water resident objects.

BACKGROUND OF THE INVENTION

Marine growth on water resident objects such as piers, waterways, oil rigs, water-going vessels, is a significant problem. In water-going vessels, for example, such as ships and boats, marine growth, such as algae, invertebrates (mussels, crustaceans) can cause significant cost, for operators of commercial shipping in particular. Marine growth can result in greater wear and tear, significant increase in fuel consumption if not treated (10%-15%) and substantial maintenance costs.

Attempts have been made to address the marine growth problem by using anti-fouling paints on surfaces, such as ships hulls, likely to be affected. Many anti-fouling paints, however, have been found to be damaging to the environment and many countries have banned or are considering implementing bans on the use of such anti-fouling paints and even on entry of ships bearing anti-fouling paints into the country's waterways. Further, anti-fouling paints can be expensive to purchase and apply and require re-application periodically.

Mechanical scrubbing techniques utilising brush cleaning machines or the like have been used to remove marine growth. Again, however, authorities often ban the use of such equipment due to the environmental effects of infestation of imported marine life in areas where the mechanical cleaning occurs. Further, where a surface has been treated with an expensive surface treatment such as an anti-fouling paint, intensive scrubbing techniques can result in damage to or removal of the surface treatment which can in turn be costly as well as potentially accentuating the environmental damage caused by the scrubbing.

It has been proposed to utilise heat treatment to treat some biological infestations of waterways and equipment used in waterways. U.S. Pat. No. 5,389,266 (Clum et al) discloses an arrangement for treating zebra mussel infestation on the bottom surface of a waterway. A heat exchanger is mounted within a chamber which confines water to an area of the bottom surface of the waterway. The heat exchanger heats the water to kill the zebra mussel infestation. The chamber is then removed from the bottom surface and the process may be repeated at another portion of the bottom surface. This treatment requires the provision of a heat exchanger within the confining chamber.

U.S. Pat. No. 5,389,266 also proposes treating the hulls of water-going vessels, such as ships, by enclosing a hull in its entirety within a chamber and heating the water within the enclosed chamber either by utilising a heat exchanger positioned in the chamber or by passing water from the chamber to an external heat exchanger, heating it and passing it back into the chamber. This method of treating ships hulls would be expensive and impractical for all types of, vessels, particularly large ships. Further, the amount of energy that will be required to heat all the water in a chamber surrounding a large hull may be prohibitive.

Soviet patent publication no. SU 119-924A discloses a method of treating algae on a hull by, firstly, shrouding at least part of the hull in an insulating jacket and then heating the hull from a heat exchanger fitted to the inside of the hull. The heat from the hull is transferred through to the algal growth. Once the algae has been killed, the insulating jacket may be removed.

This arrangement requires the positioning of an insulating jacket about a hull, which may be difficult (particularly for large vessels). It also further supposes that there is access to the inside of the hull to heat the inside of the hull so that the heat is transferred to the outside of the hull. It may be difficult in many vessels to obtain access to enough of the inside of the hull to allow effective treatment of the algae.

SUMMARY OF THE INVENTION

In accordance with a first aspect, the present invention provides a method of treating marine growth on a surface, including the steps of confining a volume adjacent a portion of the surface, introducing a heated fluid into the volume to heat the marine growth, moving the confined volume over the surface to treat other portions of the surface, and retaining the confined volume adjacent the surface regardless of the orientation of the surface.

Note that the term "marine growth", as used in this document, covers any animal or vegetable matter that may grow on any water-going object and is not limited to organisms which only occur in the sea. The term also includes organisms which occur in inland waterways and lakes.

In an embodiment, the heated fluid is at a temperature sufficient to kill the marine growth.

In an embodiment, the fluid is heated remotely and passed into the volume from the remote location. Heated fluid may be exhausted from the confined volume as further heated fluid is introduced to the confined volume. The heated fluid may be exhausted into the surrounding environment.

In an embodiment, a depth dimension of the confined volume is relatively small in magnitude. The heated fluid introduced into the confined volume may form a layer over the portion of the surface, the layer being of relatively small thickness. Advantageously, this is energy efficient as it means that the amount of heated fluid required to treat the surface is minimised, and therefore the amount of energy utilised is minimised. The actual depth dimension will in many cases depend upon the magnitude of the confined volume which may vary from application to application. In the embodiment, however, the depth dimension may be in a range of 2-50 mm, in an alternative embodiment in a range of 2-15 mm, in a further alternative embodiment in a range of 2-10 mm.

The method includes the step of retaining the confined volume adjacent the surface. The volume is retained regardless of the orientation of the surface. If the surface is a ship's hull, for example, the hull will usually be orientated facing sideways or downwards into the water and the confined volume is retained adjacent the hull. In an embodiment, magnetism is used to retain the volume adjacent the surface.

In an embodiment, the confined volume is moved over the surface it is conformed to the shape of the surface. If the shape is curved, for example, the confined volume may conform with the curved shape, so as to maintain the volume adjacent the surface.

In an embodiment, the method may be applied to treat a surface in situ. For example, if the surface is a ship's hull, then the method may be applied to treat the ship's hull below the water line.

In accordance with a second aspect, the present invention provides an apparatus for treating marine growth on a surface, including a confinement arrangement arranged to confine a volume adjacent a portion of the surface, the confinement arrangement being provided with an entry port arranged to enable introduction of a heated fluid to the volume, the confinement arrangement being movable over the surface to enable treatment of other portions of the surface, and the confinement arrangement further including a retaining means which is arranged to retain the confinement arrangement proximate the surface so that the volume remains adjacent the surface, regardless of the orientation of the surface.

The confinement arrangement is provided with a retaining means which is arranged to retain the confinement arrangement proximate the surface so that the volume remains adjacent the surface. In one embodiment, the retaining means includes one or more magnets mounted to the confinement arrangement.

In an embodiment, an exhaust means enables heated fluid that has been introduced into the volume to be exhausted from the volume. The exhaust means may exhaust the heated fluid into the surrounding environment. In an embodiment, the exhaust means is a flexible seal which borders the confinement arrangement.

In an embodiment, the confinement arrangement is in the form of a cover having a back and sides and an open face, between them forming a cavity. The open face is arranged to be positioned against the surface to be treated, edges of the sides abutting the surface. The confined volume is defined within the cavity within the cover. The sides, in an embodiment, are formed at least partially of a flexible skirt which forms a loose seal against the surface in operation. In an embodiment, the thickness of the cover is of relatively small magnitude so that the volume of water required to treat the area is relatively low. The water may form a layer over the portion of the surface being treated.

In an embodiment, the confinement arrangement is arranged to conform with the shape of the surface as it is moved over the surface. In one embodiment, where the confinement arrangement is in the form of a cover, the cover is flexible so that it can conform with, for example, a curved surface such as the hull of a water-going vessel. In one embodiment, the cover is made of a number of plates linked together so that they can move relative to each other so that overall the cover is flexible and able to conform with an uneven surface.

In accordance with a third aspect, the present invention provides an apparatus for treating marine growth on a surface, including a housing for mounting a heating means to enable heating of a portion of the surface, and a retaining means arranged to retain the housing proximate the surface, the housing arrangement being moveable over the surface to enable treatment of other portions of the surface.

In an embodiment, the heating means may include a heat exchanger. In an embodiment, the retaining means retains the housing against the surface no matter what orientation of the surface, and in one embodiment is a magnet or magnets mounted to the housing.

In accordance with a fourth aspect, the present invention provides a method of treating marine growth on a surface, including the steps of utilising a heating arrangement to heat a portion of the surface, retaining the heating arrangement against the surface and moving the heating arrangement over the surface to treat other portions of the surface.

In an embodiment, the step of retaining is carried out utilising magnetism.

BRIEF DESCRIPTION OF THE DRAWINGS

Features and advantages of the present invention will become apparent from the following description of embodiments thereof, by way of example only, with reference to the accompanying drawings, in which.

DETAILED DESCRIPTION OF EMBODIMENTS

Figures 1, 2:
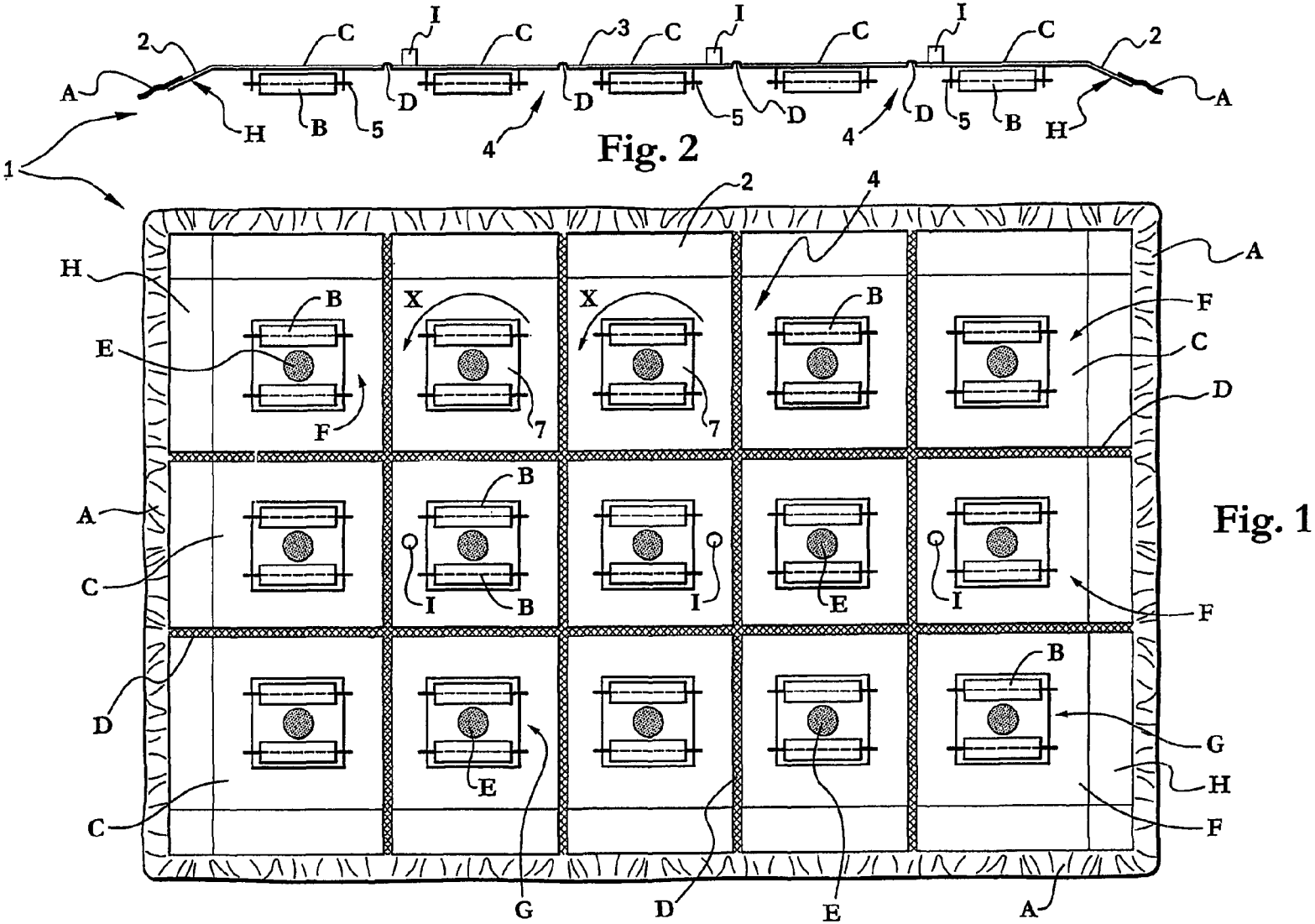
FIG. 1 is a plan view from the underside of an apparatus in accordance with an embodiment of the present invention.
FIG. 2 is a side elevation of the embodiment of FIG. 1.
Figure 3:
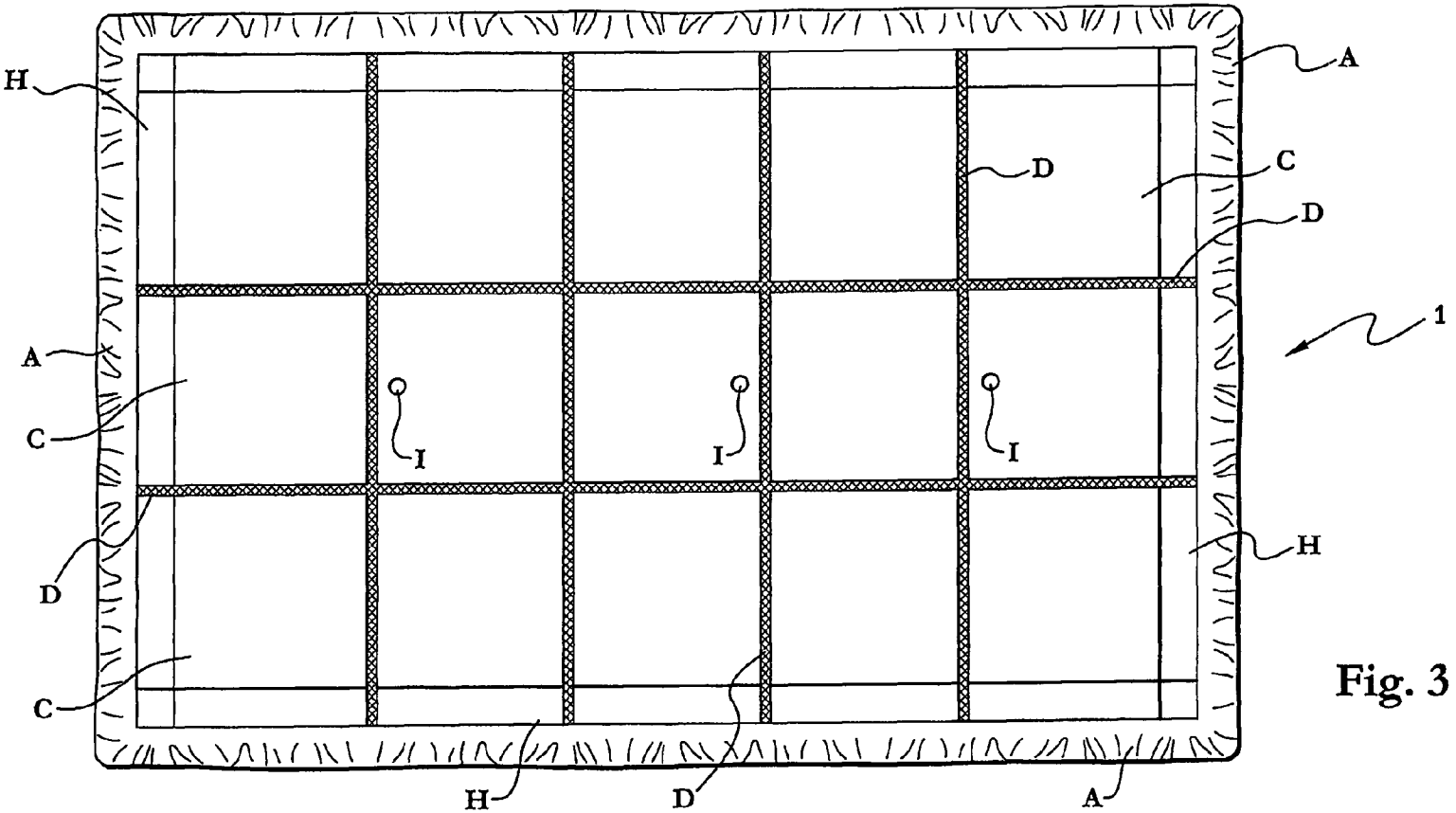
FIG. 3 is a plan view of the apparatus of FIG. 1.
Figure 4:
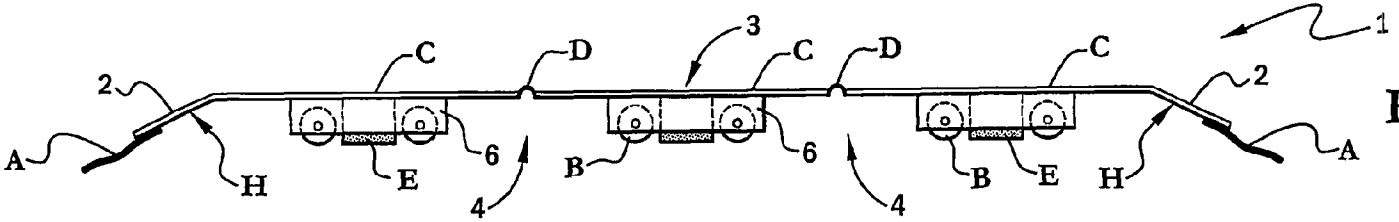
FIG. 4 is an end elevation of the embodiment of FIG. 1.

FIGS. 1 to 4 are views of an embodiment of an apparatus in accordance with the present invention. The apparatus, generally designated by reference numeral 1, is in the form of a confinement arrangement 1 arranged to confine a volume of fluid adjacent to a portion of a surface to be treated for marine growth. In this example embodiment, the confinement arrangement 1 is in the form of a flexible cover 1, comprising sides 2 and a back 3 arranged to define a space 4 within the sides 2 and back 3 for confining the volume of fluid.

The confinement arrangement 1 includes a retaining means E which is arranged, in operation, to retain the confinement arrangement (and therefore the confined volume) adjacent the surface being treated. In this embodiment, the retaining means are in the form of magnets E fixed to the underside of the cover 1. In this embodiment the magnets E are fixed in between rollers B. The rollers B operate, together with sides 2 of the cover 1 to prevent the magnets from touching the surface to be treated. The magnets B will therefore be spaced by a distance from the surface to be treated, but their attractive force will still retain the cover 1 against the surface.

The apparatus 1 also includes entry ports I which enable introduction of a heated fluid into the space 4. In this embodiment, the heated fluid is conveyed to the entry ports I by an insulated hose (to be described later) from a source of heated fluid. The heated fluid may be any fluid which can conveniently be used and can be heated to a temperature sufficient to treat the marine growth. The fluid may be water or steam, for example.

The cover 1 is flexible to enable it to conform with variations in shape in the surface being treated.

In more detail, the cover 12 includes a plurality of rigid body components C which are linked together to form the back 3 of the mat and part of the sides 2. The components C may be of aluminium square sheeting or rigid or semi-rigid synthetic material eg plastics such as Perspex™, Nylon™, Teflon™ or similar light weight materials. In this embodiment the components C are plate-like in form. A flexible hinge joint D runs X/Y across the back of the cover 1 in both directions from side to side and end to end. The joint may be a flexible material and in this embodiment is of nylon webbing (such as the material used in car seatbelts). Note that this type of flexible joint may alternatively be of a more rigid type of construction such as a door hinge type of joint. A soft neoprene flexible skirt A is formed around the perimeter of the cover 1. This flexible skirt A assists in containing the heated fluid within the space 4 and also enables fluid to be exhausted into the surrounding environment as more fluid is provided via the entry ports I.

The components C which form the outer periphery of plates C of the cover 1 have tapered portions H at their outer edges which taper off at 20°-30° and form part of the sides 2 of the cover 1.

Rollers B are mounted by axles 5 which run through side plates 6 depending from mounting 7. Mounting 7 may be in the form of a body which is mounted for rotation in a gymbal fashion. This is indicated by arrows X in FIG. 1. Because of the gymbal mounting platform 7, the cover 1 can be moved over the surface in any direction (ie sideways, upwards, downwards etc).

In an alternative embodiment, the rollers B may be fixedly mounted so that they are maintained in the same orientation. The cover 1 will then move in one direction. To move it in another direction the orientation of the cover itself will need to be changed.

Figure 5:
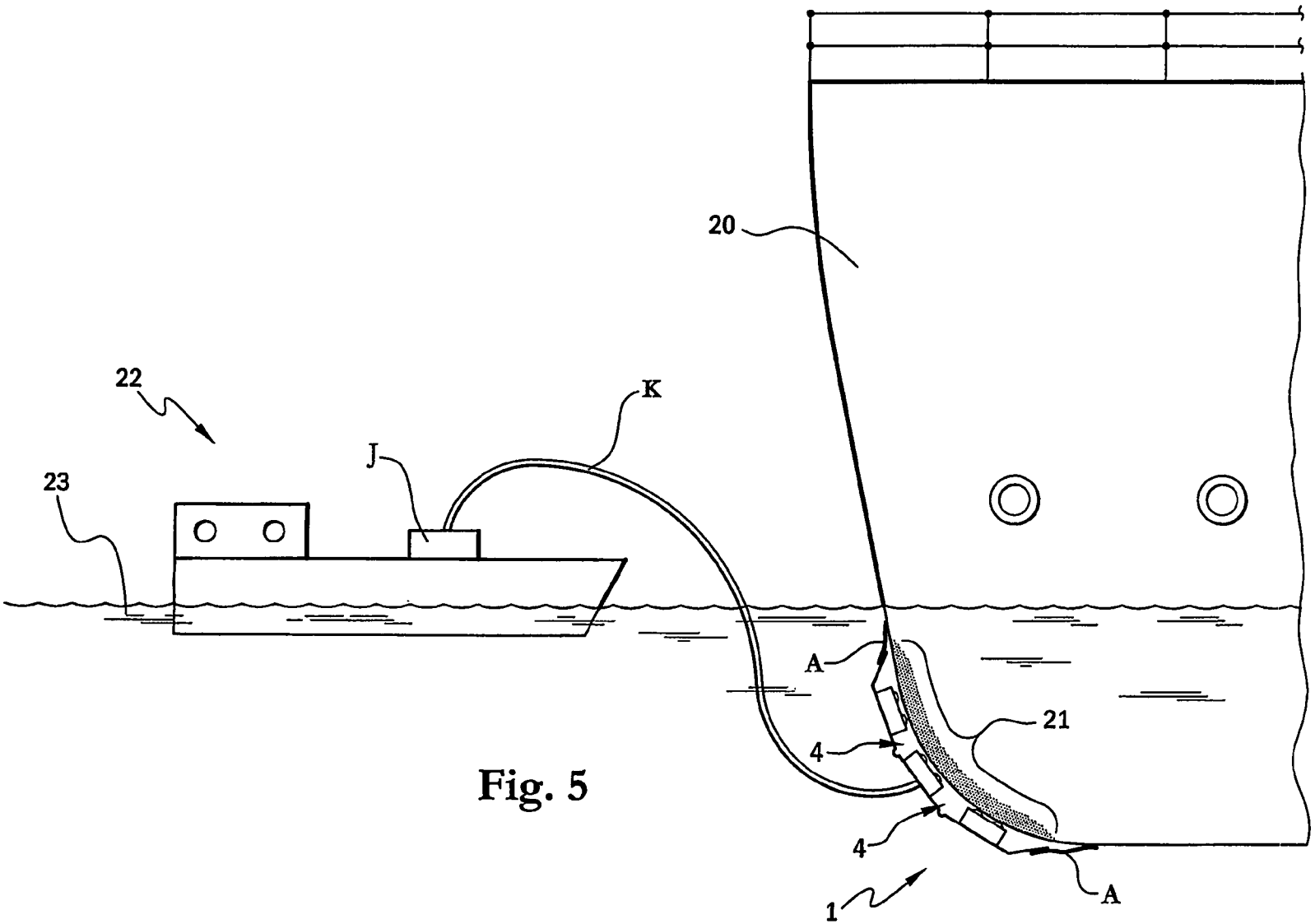
FIG. 5 is a diagram illustrating application of the embodiment of FIG. 1 in a method in accordance with an embodiment of the present invention.

An operation of cover 1 is illustrated in the FIG. 5 diagram, the surface to be treated being the surface of a ship's hull 20. The rollers B contact the surface of the hull 20. Because of the gymballed mountings 7, the cover 1 can be moved in any direction over the surface of the hull 20. The magnets E attractive force retains the rollers B and cover 1 against the surface. The magnets E are spaced from the surface a predetermined distance, but the attractive force of the magnets is sufficient to retain the mat 1 to the surface. The magnets may be rare earth magnets.

As illustrated in FIG. 5, the cover 1 encloses a volume adjacent a portion 21 of a surface of the ship's hull 20. The flexible side portions A of the cover 1 form a flexible seal against the surface portion 21. A hot water heater J on a service boat 22 supplies heated water via a flexible insulated hose K to inlet ports I. As further hot water is supplied to the volume 4 excess hot water is evacuated via the flexible seals A into the water 23. Note that hot water need not be provided from a service boat. The heater may be mounted on the ship itself, or elsewhere.

Water is provided at a temperature of greater than 50° C. and preferably greater than 60° C. for a predetermined period in order to effectively kill any organic growth on the ship's hull 20 in the portion 21. Note that temperatures and rate of application may vary depending on environmental conditions.

On an initial application, temperatures and rates of application of fluid may be varied until an ideal rate and temperature is selected.

The heated water heated by the heater J may be environmental water 23 pumped into the heater J.

To treat other portions of the ship's hull 20 surface, the cover 1 is moved over the surface. Motion may be implemented by a diver pushing the cover 1 over the surface. Alternatively, an automated arrangement may be implemented, including winches attached to the ship to "walk" the cover over the ship's hull.

An advantage of the arrangement of this embodiment is that the surface area of the mat to thickness of the mat volume ratio is quite high. The volume of water required in the mat is therefore quite relatively low. This means that not a great deal of water may need to be used. In one embodiment, the space 4 inside the mat may be limited by inserting further plastics (or other material) "fillers" attached to the plate 8, to limit the space 4 so that even lower volumes of water are utilised. Advantageously, the thickness of the internal volume of the mat is limited and may be in the range of 2-50 mm, or 2-15 mm or even 2-10 mm.

In the above embodiment, the water is an "open" system. That is, water is pumped by hose K and exhausted into the environment via the flexible seal. In an alternative embodiment, water may be provided in a closed system, where it is returned back to the heater J by a further hose (see later on in this description).

One of the advantages of the arrangement 1 of this embodiment is that when it is moved over the surface of the ship's hull 20 after treating the organic growth, it does not significantly abrade the surface so that the organic growth, although dead, is substantially retained on the surface and is not dropped immediately into the surrounding environment. When the ship is underway, however, the marine growth eventually sheds from the surface and into the environment, preferably when the ship is in the open sea, away from port.

As an alternative to utilising rare earth magnets E separate from the rollers B in the above embodiment, the magnets E may be dispensed with and the rollers B may instead be of magnetic material.

In the above-described embodiment, the cover 1 is constructed from a series of plates C connected together by webbing D. In an alternative embodiment, the entire cover may be constructed from a firm and flexible synthetic fabric to which the roller assemblies are fastened. As the fabric would be flexible it will conform with the surface as it is moved over the surface.

Further, the roller assembly which is described in the above embodiment may be altered in other embodiments to a roller assembly more similar to that of a "shopping trolley" type roller assembly.

In the above embodiment, the components are selected so that the cover 1 when constructed has a substantially neutral buoyancy in water.

An alternative embodiment of an apparatus in accordance with the present invention is illustrated in FIGS. 6 to 9. This embodiment is a confinement arrangement in the form of a cover 50 which is relatively rigid and includes a back 51 and sides 52. The cover 50 is formed from an aluminium frame 53. The aluminium frame 53 is covered in an outer neoprene sheet. The total arrangement has substantially neutral buoyancy. Magnetic wheels 11, 12, 13 and 14 are fixed inside the mat. The magnets wheels 11, 12, 13, 14 retain the mat 50 in operation against the surface to be treated. Ports 55 allow for inlet and outlet of hot water (or any other appropriate heated fluid). The sides 52 are formed from a outer side 56 and an inner neoprene flap 57, a gap 58 being formed between them which provides for some insulation.

In operation (see FIG. 7) heated water is pumped in via a hose 60 and one inlet 55 and exits the mat via hoses 61 and outlets 55. While there will be some loss of water, this arrangement is essentially "closed circuit".

Note also that this arrangement is more rigid and will not conform too well with any curved surfaces. It is envisaged that this may be a relatively small scale arrangement that could be utilised for small uncurved surfaces or small boat hulls, such as yachts.

Figure 6:
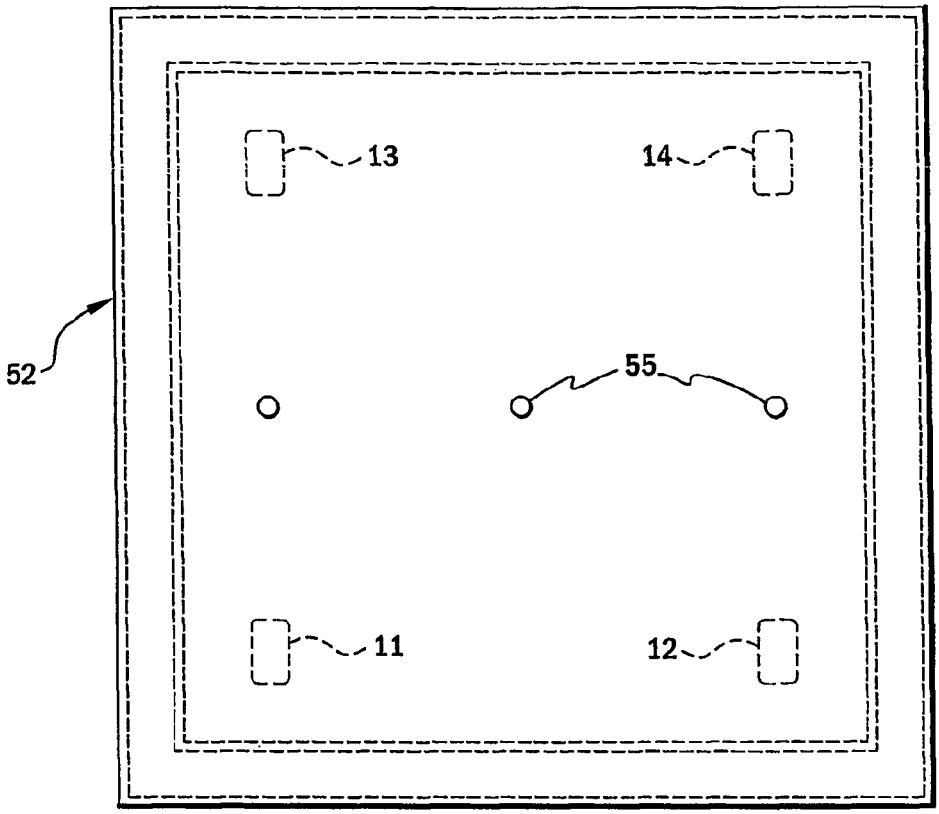
FIG. 6 is a view from the underside of a further embodiment of an apparatus in accordance with the present invention.
Figure 7:
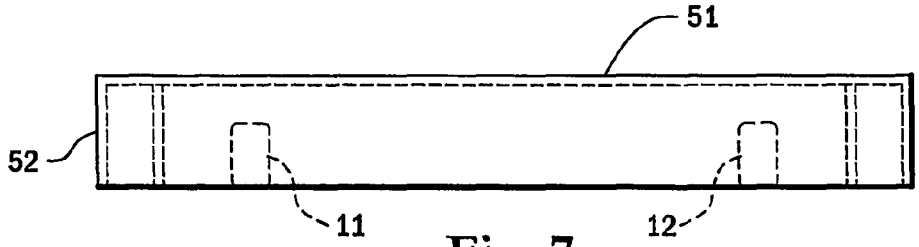
FIG. 7 is a side elevation of the embodiment of FIG. 6.
Figure 8:
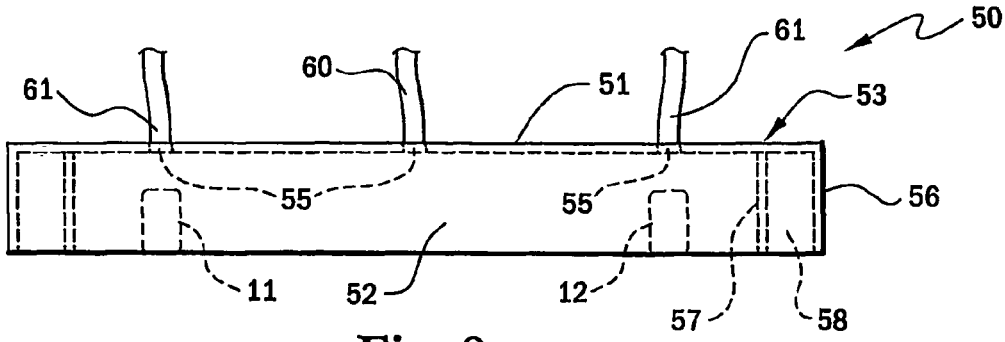
FIG. 8 is a further end elevation of the embodiment of FIG. 6.
Figure 9:
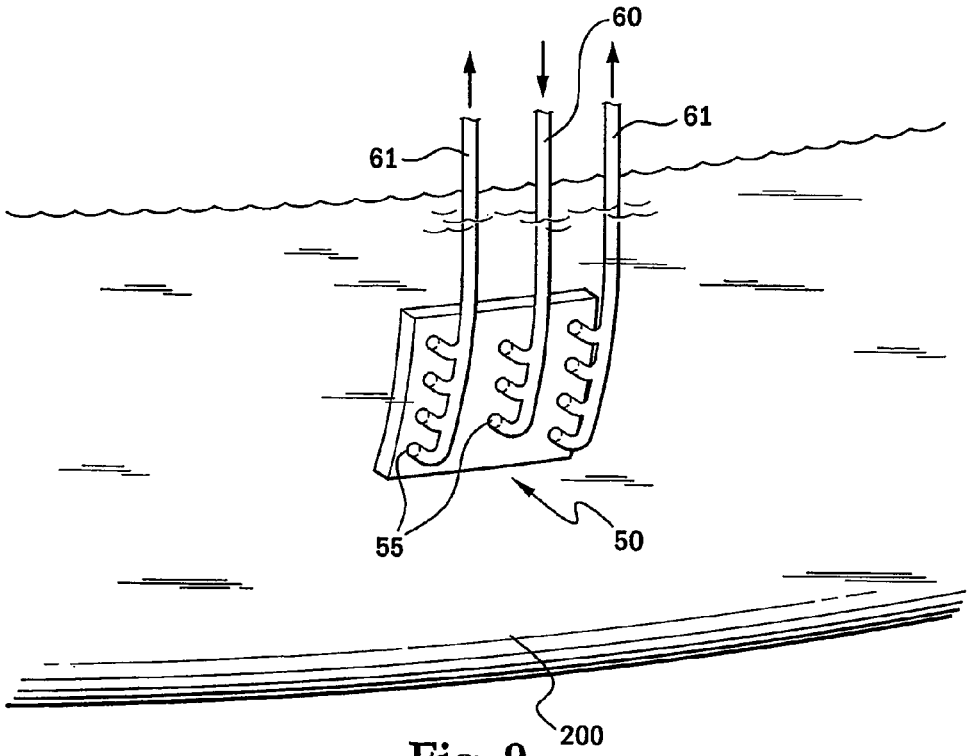
FIG. 9 is a diagram showing application of an embodiment of an apparatus in accordance with the present invention, in a method in accordance with an embodiment of the present invention.

FIG. 8 shows application of the embodiment of FIGS. 5 to 7 to a small boat hull 200. The mat 50 in this embodiment is shown with multiple inlet, outlet ports 55. Again, the mat may be moved over the surface by using a diver, or by using automated means.

The closed circulation system shown in this embodiment may be used with the embodiment of FIGS. 1 to 5, and the open circulation system of FIGS. 1 to 5 may be used with the embodiment of FIGS. 6 to 9.

Figure 10:
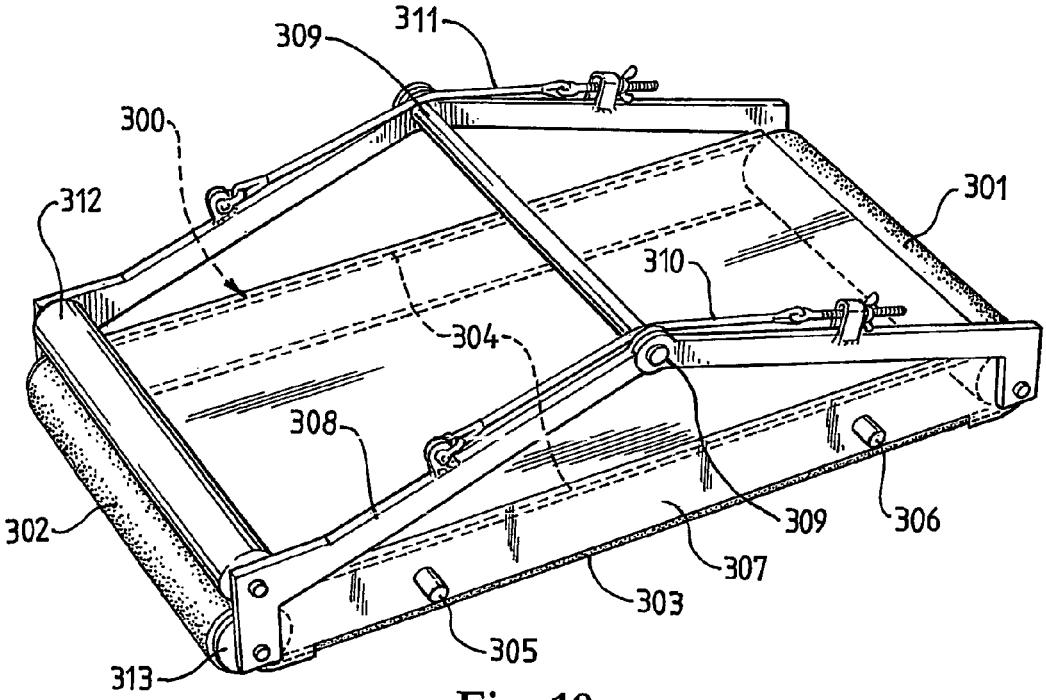
FIG. 10 is a perspective view from above and one side of a further embodiment of an apparatus in accordance with the present invention.

An apparatus in accordance with yet a further embodiment of the present invention is illustrated in FIG. 10. In this embodiment, a confinement arrangement 300 is in the form of a synthetic fabric mat 300 which is substantially porous and includes pores which form the confined volume. In operation, the map 300 is positioned adjacent a portion of a surface to heat the portion of the surface to treat marine growth on the surface. The mat 300 is mounted for motion over the surface.

In more detail, the mat 300 in this embodiment is formed as a conveyor belt mounted on a pair of rollers 301, 302 at either end of the belt 300. The bottom surface 303 of the belt 300 is in contact with the surface and forms the confined volume held against the surface and the top surface 304 is opposite the bottom surface 303, away from the surface being treated. Hot water inlets 305 and 306 are provided in a side wall 307 of an aluminium frame 308 which mounts the arrangement. Portions of the aluminium frame 308 are joined by a hinge joint 309 and rubber tensioners 310, 311 operate to tension the frame so that the belt 300 is tensioned by the rollers 301, 302.

Roller 302 is a drive roller and is provided with a drive wheel 313, which may be electrically driven. Roller 301 is an idler roller.

In operation, heated fluid (usually water) is pumped into a cavity defined by the side wall 307 of the aluminium frame 308 of the rollers 301, 302. At least one side of this cavity (the side facing the surface to be treated) is open. Fluid from the cavity is taken up by the porous mat 300 to heat the surface being treated. As the arrangement is moved over the surface, because the mat 300 is in the form of a conveyor, portions of the mat that were on the top surface 304 will be moved to the bottom surface 303 as the rollers 302, 301 drive the conveyor. This will enable the arrangement to move over the surface whilst still maintaining the mat 300 against the surface to heat and treat the surface.

Note that instead of an electrically driven roller 313, the entire arrangement may be moved manually by a diver.

Heated fluid is exhausted from the cavity either by gaps in the sides of the cavity or via the porosity of the mat 300 and the conveying of the mat 300 about the rollers 301, 302.

Embodiments of the present invention have equal application to marine growth both above and below the water line. For example, ships could be treated when they are in dry dock as well as being treated when they are in the water.

Further, embodiments of the present invention are not limited to application on ships' hulls. They can be used for any surfaces which are subject to marine growth problems eg piers, oil rig piles, etc.

A further embodiment may include a simple flexible mat with magnetic braid about its outer edges which can be fixed to the surface of the hull then moved and fixed to another portion of the surface, and into which inner volume the heated fluid can be pumped.

In the above embodiments, the mats are retained by magnetic means. Other means may be used. For example, for smaller vessels, an aluminium rod could be utilised from a surface to manually hold the apparatus against the hull. Electrically driven propellers (thrusters) situated on the back of the confinement arrangement may create a push force holding the apparatus against the surface to be treated (this is not limited to just small ships or boats). Another alternative is to provide water "jets" expelling water from the back of the apparatus causing a thrust force against the surface being treated.

In the above embodiments, heat is supplied by way of a heated fluid provided to the cover arrangement. In an alternative embodiment, a heat exchanger may be mounted in a housing which is retained to the surface and which may include castors or rollers to enable the arrangement to move over the surface. The retaining means may be magnets or other means for retaining to the surface.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of treating marine growth on a surface, including the steps of confining a volume adjacent a portion of the surface, introducing a heated fluid into the volume to heat the marine growth, moving the confined volume over the surface to treat other portions of the surface, retaining the confined volume adjacent the surface regardless of the orientation of the surface, and conforming the confined volume to the shape of the surface as the confined volume is moved over the surface.

2. A method in accordance with claim 1, wherein the step of retaining the volume adjacent the surface is carried out utilising magnetism.

3. A method in accordance with claim 1, including the further step of exhausting heated fluid from the confined volume as further heated fluid is introduced to the confined volume.

4. A method in accordance with claim 3, wherein the heated fluid is exhausted into the surrounding environment.

5. A method in accordance with claim 1, wherein the heated fluid forms a layer over the portion of the surface.

6. A method in accordance with claim 5, wherein the depth dimension of the confined volume is in the range of 2 to 50 mm.

7. A method in accordance with claim 6, wherein the depth dimension is in the range of 2 to 15 mm.

8. A method in accordance with claim 7, wherein the depth dimension is in the range of 2 to 10 mm.

9. A method in accordance with claim 1, including the further step of varying the temperature of the heated fluid during treatment, whereby to determine the most effective temperature.

10. A method in accordance with claim 1, including the further step of varying a rate of introduction of the heated fluid during treatment, whereby to determine the most effective rate.

11. A method in accordance with claim 1, wherein the surface is a surface of a hull of a water-going craft.

12. A method in accordance with claim 11, wherein the treatment is carried out under the water line of the craft while the craft is in the water.

13. An apparatus for treating marine growth on a surface, including a confinement arrangement arranged to confine a volume adjacent a portion of the surface, the confinement arrangement being provided with an entry port arranged to enable introduction of a heated fluid to the volume, the confinement arrangement being movable over the surface to enable treatment of other portions of the surface, the confinement arrangement further including a retaining means which is arranged to retain the confinement arrangement proximate the surface so that the volume remains adjacent the surface, regardless of the orientation of the surface, and the confinement arrangement further being arranged to conform with the shape of the surface as it is moved over the surface.

14. An apparatus in accordance with claim 13, wherein the retaining means includes one or more magnets mounted to the confinement arrangement.

15. An apparatus in accordance with claim 13, the confinement arrangement further including an exhaust means enabling heated fluid that is being introduced into the volume to be exhausted from the volume.

16. An apparatus in accordance with claim 15, the exhaust means including a flexible seal which borders the confinement arrangement.

17. An apparatus in accordance with claim 13, wherein the confinement arrangement includes a flexible cover.

18. An apparatus in accordance with claim 17, wherein the flexible cover includes a number of rigid components linked together so that they can move relative to each other to facilitate flexibility of the cover.

19. An apparatus in accordance with claim 13, wherein the confinement arrangement is such that the heated fluid introduced into the confined volume forms a layer over the portion of the surface.

20. An apparatus in accordance with claim 19, wherein the depth dimension is in a range of 2 to 50 mm.

21. An apparatus in accordance with claim 20, wherein the depth dimension is in a range of 2 to 15 mm.

22. An apparatus in accordance with claim 21, wherein the depth dimension is in a range of 2 to 10 mm.

* * * * *